US005493940A

United States Patent [19]

Klein

[11] Patent Number: 5,493,940

[45] Date of Patent: Feb. 27, 1996

[54] MACHINING BAR

[75] Inventor: Hansjoerg Klein, Aichwald, Germany

[73] Assignee: bielomatik GmbH & Co., Germany

[21] Appl. No.: 88,865

[22] Filed: Jul. 8, 1993

[30] Foreign Application Priority Data

Jul. 17, 1992 [DE] Germany ..... 42 23 566.9

[51] Int. Cl.[6] ..... B26D 1/36; B26D 1/62

[52] U.S. Cl. ..... 83/343; 83/346; 83/675

[58] Field of Search ..... 29/895, 895.2, 29/895.23, 895.32; 83/343–348, 663, 672–675

[56] References Cited

U.S. PATENT DOCUMENTS

| | | | |
|---|---|---|---|
| 3,151,513 | 10/1964 | Rowlands | 83/659 |
| 3,683,734 | 8/1972 | Claussen | 83/345 |
| 3,875,838 | 4/1975 | Reppert | 83/331 |
| 4,016,786 | 4/1977 | Körner | 83/343 |
| 4,420,999 | 12/1983 | Hirakawa et al. | 83/343 |
| 4,449,278 | 5/1984 | Geyken et al. | 29/895.32 |
| 4,823,659 | 4/1989 | Falasconi | 83/100 |
| 4,934,231 | 6/1990 | Chesnut et al. | 83/343 |
| 5,138,923 | 8/1992 | Kent et al. | 83/665 |

FOREIGN PATENT DOCUMENTS

| | | | |
|---|---|---|---|
| 1030672 | 5/1958 | Germany | 83/343 |
| 2601737 | 7/1976 | Germany . | |
| 1310860 | 3/1973 | United Kingdom . | |
| 1518844 | 7/1978 | United Kingdom . | |
| 1536467 | 12/1978 | United Kingdom . | |
| 2123737 | 2/1984 | United Kingdom . | |
| 2256187 | 12/1992 | United Kingdom . | |

*Primary Examiner*—Hien H. Phan
*Attorney, Agent, or Firm*—Quarles & Brady

[57] ABSTRACT

A cutter has a roller body which is made from a hollow profile-like inner part and a tubular profile-like outer part having an irregular cross-sectional shape. The outer part and inner part are such that the working flight circle of a tool on the body is approximately as near to an axis of rotation as the maximum outer circumference of the body. Apart from forming a mold core for the outer part, the inner part also forms a clamping body, and includes a supporting body and a balancing counterweight for the tool unit, thereby providing a very high cutter block strength, and at the same time, a low mass moment of inertia.

27 Claims, 3 Drawing Sheets

MACHINING BAR

BACKGROUND OF THE INVENTION

The invention relates to a tooling bar like cutter block or a similar elongated tool beam, such as is used for cutting mechanisms for flat materials, particularly in cross-cutters for webs of sheet or paper-like material. If only carried by the machine frame at their ends, such tool beams have between said ends a free, approximately rod-like tool boy which is not supported with respect to the machine frame and which defines a central or rotation axis.

With such tool beams there is often a need for high stiffness or strength values, particularly with regard to bending, torsion, stretching, etc., as well as for a low mass moment or inertia. So that cutter blocks can cut varyingly long portions from a paper web independently of a flight circle circumference of the knife edge, in conjunction with a counterknife, they are greatly accelerated or decelerated for or before each cut and this is more easily possible the lower the mass moment of inertia.

For reducing the mass moment of inertia in the case of relatively high strengths, the cutter block can be assembled from separate components. For example, a jacket of the cutter block can be made from a high-strength materials, which has a much lower specific gravity than steel of, e.g., 7, 5 or 3 kg/m$^3$ and, e.g., in the same way as a carbon fiber composite, only weights approximately 1550 kg/m$^3$, but has a much lower modulus of elasticity than steel.

This jacket can be mounted in rotary manner on a fixed axle rod passing through it, or can be provided with journals inserted at its ends, and which are mounted in machine bearings and are optionally made from a material such as steel, which has a higher specific gravity or a higher modulus of elasticity than the jacket material. In the first case the outer rings of ball bearings are connected in non-rotary manner to the inner circumference of the jacket, and in the second case this applies to the engaging journal ends. In both cases these components or inner parts only extend over very short lengths of the outer jacket or part, so that they make little or no contribution to its strength or other functions. The securing of tool or cutting units to such a jacket is problematical if securing members such as screws engage directly in the outer jacket, and do not permit high tightening torques without a risk of being torn out. The manufacture or shaping of the initially plasticized and therefore dimensionally unstable outer part is problematical, because usually a mold core is required, which with increasing length becomes more difficult to remove from the outer part.

Another disadvantage is that pronounced unbalances can occur, if further functional parts, such as tools, e.g., cutting blades or the like are fixed to the through cylindrical outer part and said unbalances can only be compensated by externally positioned counterweights, which one again greatly increases the mass moment of inertia. Finally, in the case of a rotary tool, there is a very unfavourable relationship between the maximum outside width of the tool body and the maximum flight circle diameter of the tool, which is radially far outside the maximum outside width.

OBJECTS OF THE INVENTION

An object of the invention is to provide a machining bar or a similar tool beam of the aforementioned type, in which disadvantages of known or described constructions are avoided.

Another object is to provided a machining bar which is internally equippable in such a way that as a result different functions can be performed radially inside the outer surface or the outermost addendum envelope of the tool body.

SUMMARY OF THE INVENTION

According to the invention an inner part, or several inner parts, have in the vicinity of the tool body an outer surface, which in at least one cross-section diverges from a circular shape, and the same can apply for the inner surface of the outer part. The said shape can only be provided in a single longitudinal portion or in several spaced longitudinal portions and can e.g. also be obtained in that a circular surface is traversed by at least one depression, opening or bore. One and the same inner part or separate inner parts distributed over the circumference and/or in the longitudinal direction and optionally with intermediate spacings, can fulfill numerous functions for a low weight, e.g., that of a mold core, a support core, a fixing countermember, an unbalance counterweight, a carrying member for the machine-side mounting of the tool beam, a countermember for the plastic compression of an outer part, a heat conducting member for heat action on an inner circumference, e.g., for hardening, etc.

If an imaginary regular or circular cylindrical envelope surface is placed around the outer surface of the particular inner part, or all the outer surfaces of all the inner parts provided in a given longitudinal portion then the solid material cross-section of this inner unit is appropriately smaller than the associated cross-sectional surface of the envelope surface, which can, e.g., be obtained by openings, breaks, depressions, notches, longitudinal channels, etc. These cavities can also be filled with a very light material, which has much lower strength values than the material of those areas of the inner part unit which are provided for receiving mechanical loads. The particular cavity can be provided over its length or the length of the tool body with constant or stepped, and/or continuously progressively changing cross-sections.

In the vicinity of the envelope surface the inner part unit is appropriately substantially closed over the entire circumference and/or the entire length of the tool body, and is at the most traversed by narrow openings, gaps, etc., whereas larger openings, such as threaded bores can be closed with suitable inserts. Therefore the inner part is particularly suitable as a mold core for shaping an outer part from initially still plasticized material.

Independently of the described construction very advantageous effects of an inner part unit are obtained, if it extends over a length, which is at least as large as the greatest width of the inner envelope surface of a substantially hollow, wider component, e.g., an outer part, which as the largest cylindrical or circular envelope surface fits in said wider component. Thus, in the spacing between the end portions of the tool body or the tool beam, the inner part can take over further functions, particularly those of the indicated type. This is particularly the case if the inner part is not rotatable or is only rotatable over no more than a complete revolution compared with the wider component, which can have longitudinal portions, which are free from inner parts, e.g., if individual inner parts are successively arranged in longitudinally spaced manner. However, of the total length of the tool body or beam appropriately at least 1/20 is occupied with at least one inner part, and each integral multiple of this value can be provided in accordance with the requirements up to the occupancy over the full length. Parts of the inner part unit or the entire inner part can also be in the form of a slide-in part, which is inserted longitudinally in a wider inner part or an outer part.

Independently of the described constructions, a particularly advantageous design of a tool beam is obtained if the radial spacing of the working area of the associated tool from the central or gravity axis of the tool beam is smaller that the sum of the maximum radial spacing of the outer surface of the tool body and the radial extension of a tool unit fixed to said outer surface. This particularly applies to tool beams in which a tool holder projects radially outwards over connected portions of the curved outer surface or is formed by a separate component, or which is detachable as a whole from the prefabricated tool body and which supports the tool directly against all cutting pressures. In the case of a rotary tool beam, the flight circle diameter of the engagement area of the tool need only be made larger by this engagement depth, plus a smaller safety factor, than twice the radial spacing of said outer surface. The safety factor can be approximately the engagement depth or 2 to 5 times the same and it is adequate in the case of a rotary tool beam if said outer circumference with a countertool defines a gap which is just sufficiently wide to enable the cut product or paper to pass through without binding friction.

Independently of the described constructions very advantageous effects can be obtained if at least one of the components has in at least one given cross-section different wall thicknesses or different thicknesses of its solid cross-section. Therefore, these thicknesses can be adapted to the given loading conditions or the desired functions. In the function of an outer part or the inner part such thickness changes are appropriately progressive or stepfree.

Another advantageous further development of a tool beam is obtained, independently of the described constructions, in that the outer circumference of the tool body forms at least one interlocking member, in which a functional part, such as a tool unit, can be inserted in such a way that without using additional securing members it is secured positively or approximately clearance-free, and therefore, in accurately an oriented manner in at least one direction transversely to the insertion direction. This interlocking member can cooperate with outer surfaces of the functional unit and is advantageously produced by plastic deformation.

The inventive construction is particularly suitable for those elongated tool beams, whose length is at least twice more than double the greatest radial spacing of the outer surface of the tool body from the central or gravity axis. This length can also be any integral multiple of this double radial spacing, e.g., up to 10 or 15 times, particularly favorable conditions being obtained if the length is approximately 6 to 7 times the same.

The method according to the invention for production of a tool beam of the described or some other type advantageously comprises at least one tool undergoing in one operation a shaping action by plastic forming. This not only leads to a material compression which increases the strength, but also in the working state, interengaging components can be very narrowly and uninterruptedly connected together even if they can be separated from one another easily and in a non-destructive manner. In the case of a forming or shaping of the component from relatively light, flowable or pasty material, which plastically gives way under finder pressure and which has a tendency toward inclusion of gas or air bubbles, as a result of the plastic forming or pressure loading, such inclusions of gas or air bubbles are expelled. In addition, as a result of the plastic forming, different wall thicknesses of the component can be obtained over the circumference and/or in the longitudinal direction of the tool beam and can consequently be adapted to the particular requirements.

At least one inner part could be partly made from non-metallic material or from the same or similar material to an outer part, but it is advantageous if at least one inner part is partly or completely made from steel. If an inner part unit comprises separate, assembled individual parts, then they are appropriately fixed together by adhesive or melted joints, e.g., by bonding, welding, brazing, etc. At least one resulting seam can also form a smooth or flush and stepfree-connecting intermediate area of the outer surface of the inner part unit.

BRIEF DESCRIPTION OF THE FIGURES

These and further features can be gathered from the claims, description and drawings and the individual features, both singly and in the form of sub-combinations, can be realized in an embodiment of the invention and in other fields and can represent advantageous, independently protectable constructions for which protection is hereby claimed. Embodiments of the invention are described in greater detail hereinafter relative to the drawings, wherein:

DETAILED DESCRIPTION OF PREFERRED EXAMPLE EMBODIMENTS

Figure 1:
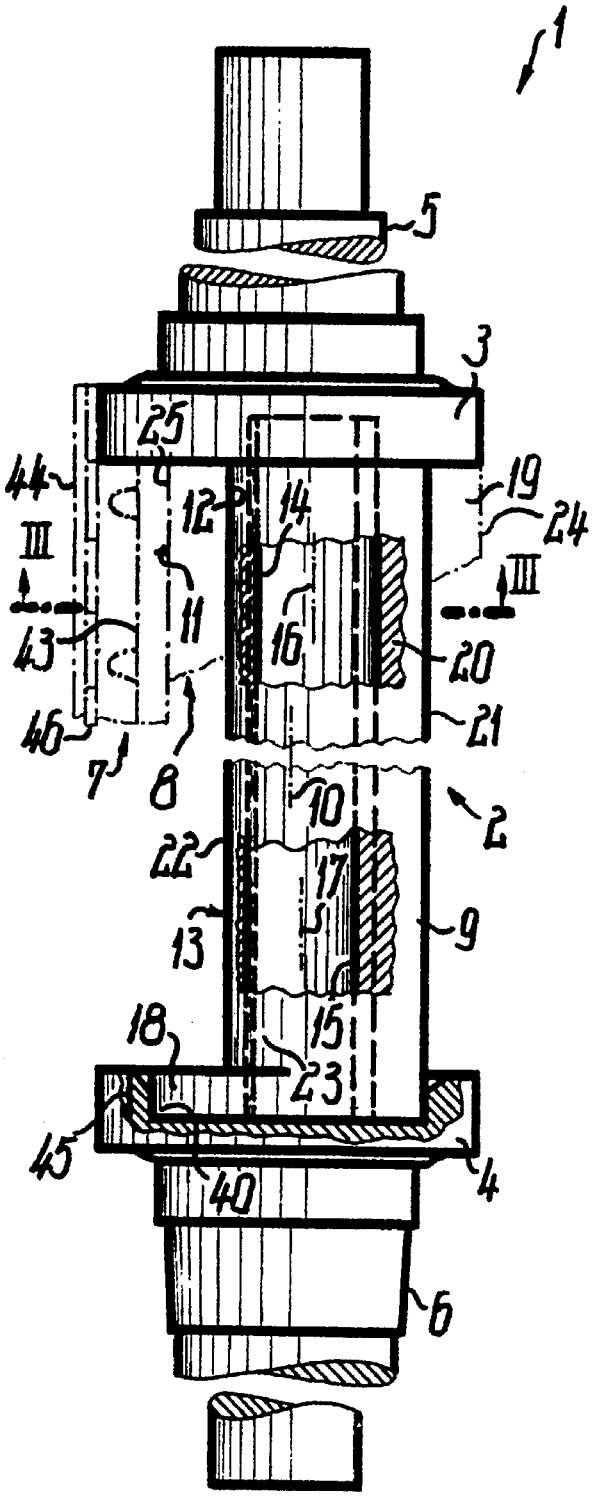
FIG. 1 illustrates a core component of a cutter block according to the invention.

A tool or cutter block 1 according to the invention has in a spaced manner between its ends as the longest main portion a hollow body 2, which is connected by each end to one face of a circular ring-like, cylindrical end flange 3 and 4, which over its axial extension can be drawn partly or entirely into the cutting working length of the cutter block 1. To the outer face of each end flange 3 and 4 is connected an outwardly, multiply stepped, tapered journal 5 and 6 constructed in one piece with the latter, and having a reduced cross-section compared therewith. To the outer circumference of the body 2 is fixed a tool unit 7 which is uninterrupted over its length and whose effective tool part can extend over and beyond the inner surface of the associated end flange 3 or 4 approximately up to its outer face. The tool unit 7 can be constructed as a cross-cutter, cross-perforator, cross-stamper or some other tool.

The body 2 is assembled from two component units, namely a substantially one-piece outer part 8 and a substantially one-piece inner part 9 and defines with the journals 5 and 6 and the end flanges 3 and 4, an axis 10, which can be a central, gravity and/or rotation axis. The substantially seamless, tubular outer part 8 over its entire circumference has as the inner circumferential surface an inner surface 12 and as the outer circumferential surface an outer surface 11, whereof at least one passes uninterruptedly with substantially constant cross-sections over the entire length of the body 2. A corresponding outer surface 13 and two separate inner surfaces 14 and 15, in each case closed over the circumference, also forms the hollow inner part 9, with one or all the inner surfaces 14 and 15 extending over the inner faces of one or both flanges 3 and 4 over a portion of the axial extension thereof in such a way that their tightly closed ends are spaced from the associated outer face of the end flange 3 and 4. The particular face of the outer part 8 is connected uninterruptedly or in pressure-tight manner to the inner face of the associated end flange 3 or 4.

The inner surfaces 14 and 15 are formed by two approximately axially parallel, cross-sectionally through constant hollow chambers, whose axes 16 and 17 are approximately parallel to the axis 10 and are on either side of the latter. The axes 16, 17 can be looked upon as central axes or imaginary gravity axes of the associated chamber cross-section. The inner part 9 can be constructed in one piece with an end flange 3, e.g., as a casting. It has at its end remote from the end flange 3 an approximately circular segmental, disk-shaped connecting flange 18 projecting over part of its outer surface 13, and which with the inner part 9 forms an approximately cylindrical, outer circumferential surface extending over the circumference. The axial extension of the flange 18, which is optionally in one piece with the remaining inner part, is smaller than that of the associated end flange 4, which has in its inner face a shallow, cup-shaped depression closely adapted to the connecting flange 18 and in which the latter is inserted in such a way that its inner face terminates flush with the inner face of the end flange 4 and is located therewith in a common plane at right angles to the axis 10. Thus, the inner part, over at least a portion of its circumference, can be frontally connected in the described manner to the inner face of the connecting flange 18. The connecting flange 18 can also be formed by a separate component fixed by welding or the like, particularly if the inner part 9 is formed by an extruded profile or the like.

With its jacket, the outer part 8 forms a wall 19, which can have over the circumference an approximately constant or slightly varying thickness, e.g., in such a way that the greatest thickness exceeds the smallest thickness by approximately ⅕ to ½ and appropriately the greatest thickness is approximately ⅓ greater than the smallest thickness. A corresponding wall 20 with much greater thickness variations is formed by the inner part 9, the greatest thickness of this wall being approximately the same as that of the wall 19 or greater and the smallest thickness is much smaller, namely approximately 1 mm or under 10 or 5 mm.

The outer surface 13 forms an approximately part cylindrical arc or arcuate surface 21 curved by approximately 180° about the axis 10, an approximately planar flat surface 22 which is approximately symmetrical to its median plane and convex, pitch circular transition surfaces 23 between these two surfaces 21 and 22. The arcuate surface 21 is substantially on the side remote from the flat surface 22 and is spaced from the axis 10, e.g., by approximately half the distance than the corresponding radial spacing of the arcuate surface 21. The flat surface 22 can also be slightly convex-curved with a radius of curvature which is substantially larger than its greatest spacing from the arcuate surface 21 and is approximately 3 to 10 and in particular 5 times the radius of curvature of face 21. The approximately quadrantal or slightly larger transition surfaces 23 have a much smaller radius of curvature than the arcuate surface 21, namely corresponding roughly to spacing between the flat surface 22 and the axis 10. The transition surfaces 23 are continuously and tangentially connected to the surfaces 21 and 22, i.e., in edge and step-free manner.

A corresponding larger radius of curvature arcuate surface 24 substantially symmetrical to the arcuate surface 21 is formed by the outer surface 11 and its arcuate surface 24 extends approximately over at least the same or a larger arc angle to the arcuate surface 21. The approximately part cylindrical arcuate surface 24 which is curved around the axis 10 passes via transition surfaces 26 and 27 into a flat surface 25, which is approximately parallel to the flat surface 22, on the same side of the axis 10 and approximately symmetrical to the flat surface 22. Like the flat surface 22, the flat surface 25 can be slightly convex instead of approximately planar and its curvature axis can be approximately the same distance, further or nearer to the axis 10 than the flat surface 22, as a function of the thickness changes of the wall 19 in the vicinity of the flat surface 25.

In the manner described hereinbefore relative to the transition surfaces 23, the transition surfaces 26 and 27 are connected to the surfaces 24 and 25. The transition surfaces 23 can have different or identical radii of curvature to the transition surfaces 26 and 27, in whose vicinity the thickness of the wall 19 can circumferentially vary or be constant. The width of the flat surface 25 between the transition surfaces 26 and 27 can be approximately the same as the greatest radius of curvature of the arcuate surface 24, while the corresponding width of the flat surface 22 is larger than the arcuate surface 21. The curvature axes of the two approximately concentric transition surfaces 23 and 26 or 23 and 27 can be approximately equiaxial or reciprocally displaced in such a way that the thickness of the wall 19 in the vicinity of the pair of transition surfaces constantly increases and/or decreases with respect to the flat surfaces 22 and 25. The radii of curvature of the two transition surfaces 23 are smaller than the average radii of curvature of the two transition surfaces 26 and 27.

The flat surface 25 is used for the approximately radially braced securing of the tool unit 7 in such a way that its tool or cutting edge is approximately in the center of the length of the body 2 approximately in the axial plane 31 of the axis 10 which is oriented at right angles to the flat surface 25. The tool unit 7 with the securing members 47 and accompanied by the interposing of the associated portion of the wall 9, is directly braced against the inner part 9 and namely against that portion thereof located on the same side of the axis 10. Compared with the axial plane 32 of the axis 10 approximately parallel to the flat surfaces 22 and 25, and at right angles to the axial plane 31, said portion is on the same side as the tool unit 7 and said portion forms an approximately plate-like clamping body 28, whose average wall thickness is smaller than the greatest wall thickness of the inner part 9 on the other side of the axial plane 32, or is greater than the minimum wall thickness in the vicinity of the axial plane 32. On the side remote from its flat surface 22, the clamping body 28 is bound by the two inner surfaces 14 and 15, whose minimum spacing is smaller than the average thickness of the clamping body 28.

The securing members 47 can, e.g., be screw bolts, whose inner ends consequently project freely into the hollow chambers 14 and 15, because the clamping body 28 in its corresponding areas is traversed by bores, such as threaded bores, approximately at right angles to the flat surfaces 22 and 25. Through the two inner surfaces 14 and 15 the clamping body 28 is cross-sectionally approximately T-shaped. On the side of the axial plane 32 remote from the tool unit 7 the inner part 9 forms a weight body 29, so that the weight of the portion of the inner part 9 on this side of the axial plane 32 is greater than the weight of the corresponding portion on the other side of the axial plane 32. The cross-sectionally approximately T-shaped weight body 29, with respect to the axis 10, serves as a counterweight for the tool unit 7, and therefore the balancing the cutter block 1.

The supporting body 28 and the weight body 29 are constructed in one piece with one another as a cast or extruded profile and pass into one another via three wall webs at right angles to the axial plane 32. The two outer wall webs 36 and 37 forming the outer surface 13 can be of approximately the same size or have different minimum wall thicknesses. Their wall thickness can be approximately the same or smaller than the minimum wall thickness of the wall web located between them. Between the inner surfaces 14 and 15 said all web forms the common T-foot of the clamping body 28 and the weight body 29, as well as a web-like supporting body 35, whose median plane is approximately at right angles to the flat surfaces 22 and 25 spaced between the remote longitudinal boundaries of the tool unit 7, and approximately parallel to the axial plane 31 and/or approximately coinciding therewith.

The supporting body 35 is connected in one piece with the weight body 29 and supports the clamping body 28, with the part of the wall 19 between the flat surfaces 22 and 25 and the tool unit 7, at least with respect to the radial cutting pressure relative to those areas located on the other side of the axial plane 32.

Figure 3:
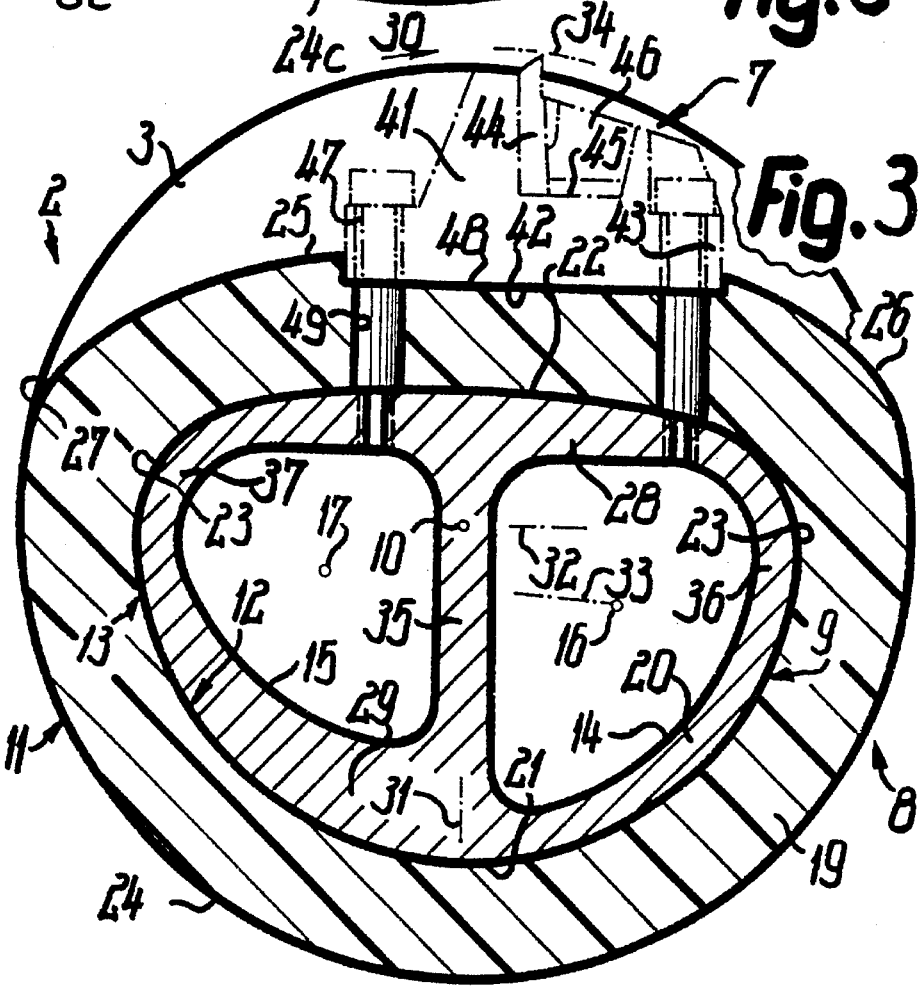
FIG. 3 is a cross-section view through the cutter block along line III—III in FIG. 1 on a larger scale.

According to FIG. 3, the working rotation direction 30 of the cutter block 1 is dextrarotatory, and approximately in the center of its length the cutting edge of the tool unit 7, is in the axial plane 31. With respect to the axis 10 the cutting edge has an approximately contiual inclination of a few radians or fractions thereof, in such a way that its end located at the end flange 4 is slightly set back against the rotation direction 30 with respect to the axial plane 31 and its other end is set forward by the same amount in the vicinity of the end flange 3 in a rotation direction 30 with respect to the axial plane 31. Thus, when working, initially only the end of the tool unit 7 associated with the end flange 3 comes into working engagement, and then it gradually migrates along the unit 7 during rotation by said arc amount towards the others end. The shaft journal 6 associated with the end flange 4 also has a frustum-shaped portion, over which the axial clearance or the axial compressive stress of the cutter block 1 in the machine bearing can be adjusted.

The gravity axis of the tool unit 7 which is roughly parallel to the axis 10, is slightly set forward with respect to the axial plane 31 in the rotation direction 30, so that the corresponding gravity axis of the weight body 29 is located on the other side of the axial plane 31. If as a result of said inclination of the tool unit 7 there is a corresponding inclination of its gravity axis, then the gravity axis of the weight body 29 can have a coinciding inclination, so that advantageously in each length portion of the body 2 there is a specific balancing. There is also such a local balancing for the end flanges 3, 4 or the connecting flange 18.

The displacement of the gravity axis of the weight body 29 relative to the axial plane 31 can easily be achieved in that the concave and/or planar inner surfaces 14 and 15 have different widths and/or different axial spacings with respect to the axial plane 31 or 32. The inner surface 14 located significantly upstream of the axial plane 31 in the rotation direction 30, and optionally approximately tangentially adjacent thereto, transversely to the axial plane 31 or 32, advantageously has a slightly greater width than the inner surface 15, and on the side of the axial plane 32 remote from the tool unit 7 extends further than the inner surface 15. The axes 16 and 17 of the inner surfaces 14 and 15 are located on the side of the axial plane 32 remote from the flat surfaces 22 and 25, with the spacing of the axis 16 of the inner surface 14 being slightly larger, so that the common axial plane 33 of the two inner surfaces 14 and 15 is inclined by a small angle to the axial plane 32, and diverges with the latter on that side of the axial plane 31 on which the inner surface 14 is located.

The inner surfaces 14 or 15 which are only approximately concentrically within one another between the arcuate and flat surfaces on the one hand, and the transition surfaces 23 and 26 or 23 and 27 on the other, are not precisely equiaxial to one another and instead the axes 16 and 17 of the inner surfaces 14 and 15 are further removed from the flat surfaces 22 and 25 than the curvature axes of the associated transition surfaces and the curvature axes of the associated portions of the inner surfaces 14 and 15. These, in each case, associated curvature axes can have roughly the same spacings from the axial plane 31, so that their common central and axial planes are parallel to the axial plane 31.

The spacing of the axis 16 from the axial plane 31 can be slightly smaller than the corresponding spacing of the axis 17. The central radius of curvature of the transition surface 26 located upstream of the cutting edge or tool unit 7 in the rotation direction 30, can be smaller than the transition surface 27 positioned behind it, namely, e.g., approximately ⅓ smaller, so that the median plane of the flat surface 25 parallel to the axial plane 31 can be displaced with respect to the median plane of the flat surface 22 or the axial plane 31 in the rotation direction 30 by an amount corresponding to the amount by which the gravity axis of the tool unit 7 is positioned upstream with respect to the axial plane 31.

The average and the minimum wall thickness between the inner surface 14 and the outer surface 13 can consequently be slightly larger than the minimum wall thickness between the inner surface 15 and the outer surface 13. The cross-sectionally, approximately circular segmental weight body 29 is connected in supporting manner by the three spaced wall webs 35, 36 and 37, and in one piece to the clamping body 28.

The spacing of the assembly or flat surface 25 from the axis 10 is smaller compared with the maximum radial spacing of the outer surface 11 or the arcuate surface 24 of the body 2 by an amount which is only slightly smaller than the radial extension of the tool unit 7 relative to its cutting edge compared with the axis 10. Thus, the flight circle 34 of the cutting edge is only with a gap spacing outside the maximum cylindrical envelope surface, which can be placed around the axis 10 so as to touch the outer surface 11. The circumferential surface of the connecting flange 18 has the same radius of curvature as the arcuate surface 21 and is equiaxial thereto, so that in cross-section through the connecting flange 18 and over its length there are closed circular shapes over the circumference.

The circumferential surface of the in axial view crescent-shaped connecting flanges 18 projecting over the flat surfaces 22 and 25 passes continuously into the arcuate surface 21. The tool unit 7 contacts the outer surface 11 appropriately only in the vicinity of the flat surface 25 and is secured spaced on either side of the median plane 31 or the cutting edge with the fixing members 47 with respect to the inner part 9, and they are distributed in rows approximately over the entire length of the tool unit 7.

As in particularly shown in FIG. 3, the inner part 9 is produced in cutting-free manner as an extruded profile, so that the inner surfaces 14 and 15 in cross-section have, parallel to the axial plane 31, a greater cross-sectional extension than transversely thereto or parallel to the axial plane 32. The wall thickness of the inner part 9 can consequently be substantially constant on the side of the axial plane 31 associated with the front of the tool and in the vicinity of the transition surface 23, and only increases following on to the clamping body 28.

For the manufacture of the cutter block the starting product is appropriately a blank, which is, e.g., formed by a cut to length portion of an extruded material profiled in accordance with the inner part 9. If the blank is formed by a casting, then the inner part 9 can be constructed in one piece with a single end flange 3 or 4, or a journal 5 or 6, or in one piece with both the corresponding end parts, as is shown for the end flange 3. In the case of a non-one-piece construction, the roller body is assembled with the end flange 4 or the journal, and optionally at the particular end with a connecting flange 18. The end flange has in its inner face an engagement member 40 in the form of a depression on the bottom spaced between the faces of said end flange, which is closely adapted to the flange 18 in such a way that the two components, following axial assembly, are precisely centered in a clearance-free manner relative to one another, as shown for the end flange 4. The open end of the engagement member 40 is widened by a chamfer or the like, so that the two components can be non-detachably interconnected by means of a welding seam, which is connected to the chamfer and the outer circumference of the connecting flange 18 or the arcuate surface 21. In this production phase the journal 5, like the journal 6 and/or the associated end flange 3 or 4, can be unworked as a blank or only preworked, and the inner face of the end flange 4 or 3 may not yet be completely worked. The roller core optionally only comprises two one-piece components.

This makes it possible to finish the working of the inner face of the end flange 3 or 4 and the connecting flange 18, including the possibly still projecting annular welding seam, the outer circumferential surface of the end flange 3 or 4, and/or the journal 5 or 6 in a single setting of the workpiece, which leads to a very high manufacturing accuracy. The bottom face of the engagement member 40 closes the open ends of the blind hole-like inner surfaces 14 and 15 in a tight manner, so that no moisture can penetrate.

Onto the cross-sectionally approximately D-shaped outer surface 13 of the resulting workpiece is wound a carbon fiber woven material with a backwards and forwards pitch of, e.g., approximately 45°, accompanied by impregnation with a flowable binder in such a way that it forms the wall 19 initially with a constant thickness in a directly adhering manner, and subsequently on both inner faces of the end flanges 3 and 4 or the connecting flange 18. The web of woven material used in much smaller than the spacing between the inner faces and at the lateral longitudinal edges is bounded in a cut-free manner by woven edges, on which the wefts are reversed in a one-piece loop or hairpin-like manner, optionally accompanied by the rounding of one or more warps transversely thereto.

It is also conceivable for the woven material web to have roughly the same width as the spacing between the inner faces and to wind it in pitch-free manner about the outer surface 21. If the woven material edges have a greater thickness than the remaining areas of the web, then the outer surface 21 following on to the associated inner surface can e so width-reduced, that it precisely or completely receives the resulting thickening of the winding body, and therefore the external width of the wall 19 in these areas is the same as in the areas between them. During winding, the longitudinal edge crosses the arcuate gap between the outer circumference of the connecting flange 18 and the inner circumference of the engagement member 40, so that this gap is partly or completely covered by the wall and/or the tool unit 7. The arcuate surface 24 has approximately the same curvature as the outer circumference of the end flange 3 or 4, so that it passes continuously up to its outer face.

Following this method step the preshaped wall 19 is still relatively soft, plastically deformable, and its inner face 12 engages over the entire circumference and length uninterruptedly on the outer surface 13. Prior to the application of the wall 19 or well before the end of this process in the clamping body 28 or the inner part 9, are inserted several securing members uniformly distributed over its entire length, e.g., headless threaded bolts in threaded bores, which can be the same threaded bores which are used for securing the tool unit 7 in the ready to work state. The number of these previously inserted securing members is much smaller than the number of securing members used for the ready to work state, and the securing members used in conjunction with the production of the wall 19 can be provided in two rows on either side of the axial plane 31. The wall 19 is so built up on the outer surfaces 13 that the inserted securing members are not covered and instead, after the manufacture of the complete, but still plastic premould of the wall 19, they traverse the latter and their ends project freely over the flat surface 25. The securing members to be anchored prior to the plastic application of the outer part **8*a* in the clamping body 28*a* can be detached and removed in destruction-free manner following the curing of the outer part 8*a*, and can then be replaced by the securing members 47**, which are appropriately formed by cap screws.

The tool unit 7, or an elongated, strip-like, one-piece tool base 41 associated therewith is then engaged with an approximately planar supporting surface 42 on the preshaped flat surface 25 in such a way that it can be secured with slight pressure with the previously inserted securing members, accompanied by the compression of the associated, approximately planar portion of the wall 19, against the flat surface 25, and therefore, against the flat surface 22. To this end the base 41 can have on both longitudinal sides projecting, flat and/or common plane-positioned flange webs 43, which form the associated areas of the supporting surface 42, and have through openings for the securing members, so that nuts or the like to be fitted on their free ends serve to secure the base 41.

By varying tightening of the securing members on both sides of the axial plane 31, the base 41 can be oriented in its tilting position with respect to the flat surfaces 22 and 25 or the axial planes 31 and 32. In each case the bracing of the base 41 leads to a slight plasmatic deformation of the associated, connecting areas of the wall 19, because under the securing pressure the plastic material of the wall 19 is expelled towards both longitudinal sides of the base 41 or in the direction of the transition surfaces 23, 26 and 27. As a result, the previously constant wall thickness can decrease between the flat surface 22 and the supporting surface 42, and increase more between the transition surfaces 23 and 26 than between the transition surfaces 23 and 27. This leads to improved values with respect to the strength, damping and concentricity characteristics of the outer part 8, particularly as the transitions between different wall thicknesses are substantially progressive and not abrupt.

Particularly if the base 41 is at least partly constructed with said helical pitch with respect to the axis 10, and is correspondingly twisted in its longitudinal direction in the vicinity of its supporting surface 42, then as a result of the described procedure the supporting surface 42 or a corresponding auxiliary base in the vicinity of the flat surface 25 can create a narrow, uninterrupted counterface without any need for machining of the wall 19. The orientation of the base 41 with respect to the axes at right angles to its longitudinal direction, namely axes which are at right angles to the axial plane 31 or 32, as a result of the described procedure, can take place just as simply as the orientation about an axis roughly parallel to the axis 10.

According to FIG. 3, the base 41 is drawn to such an extent into the plastic mass of the wall 19, that a receptacle 48 in the form of a depression is formed in the flat surface 25. The receptacle 48, whose depth is smaller than the thickness of the flange webs 43, is consequently closely adapted in a clearance-free manner to the outer shape of the associated portion of the base 41, i.e., not only to the supporting surface 42, but also the areas of the longitudinal edge faces or flange webs 43 connected at right angles thereto, and which project radially outwardly with most of their thickness from the receptacle 48. Therefore, the base 41 of the tool unit 7 transversely to the axial plane 31 is positively connected to the body 2 even when the securing members 47 have not been inserted.

At the receptacle 48 bounded cross-sectionally in a multiply stepped or angled manner in the vicinity of the angle transitions of the reinforcing material of the outer part 8, or the warp and/or weft, threads of the woven material pass in an uncut, uninterrupted manner, namely, following the bends.

The wall 19 is appropriately provided, following curing, with thread-free through-bores 49 for the securing members 47, the bores 49 being congruent to roughly equal width bores in the flange webs 43. The securing members 47 then engage in threaded bores of the clamping body 28, which can be produced prior to the application of the wall 19, or subsequently, or following the curing thereof. The bores 49 can also be formed by shanks inserted in the threaded bores prior to the application of the outer part and are then produced in cutting-free manner.

The length of the base 41 is advantageously closely adapted to the spacing between the inner faces of the end flanges 3 and 4, so that a substantially clearance-free longitudinal alignment of the base 41 between said faces is possible. The base 41 appropriately does not project over the outer circumference of the roughly equal diameter end flanges 3 and 4, and instead extends circumferentially on either side of the cutting edge approximately up to said outer circumference. In order to avoid a firm adhesion of the shaping auxiliary base or the securing members to the still plastic wall 19, the supporting surface 42 or the securing member is appropriately provided with suitable separating or parting means.

Following this preparation, the workpiece is subject to a heat treatment or a treatment leading to the curing of the outer part 8 and this, e.g., takes place in an oven. If this treatment is carried out in a vacuum in a chamber, then any gas bubbles enclosed between the surfaces 11, 12 and 13 can be expelled through the outer surface 11.

If said treatment takes place at relatively high temperatures, then the finished working of the particular journal 5 or 6, or the outer circumference of the end flange 3 or 4 can take place following this, e.g., by grinding. If the journal 5 and end flange 3 are constructed in one piece with the inner part 9, and said part is connected in a high strength, substantially monolithic manner with the one-piece component constituted by the end flange 4 and the journal 6, then very high strength values are obtained, although there is a greatly reduced weight due to the hollow chambers 14 and 15. The base 41 is made from a much harder material, e.g., steel, than the plastic material of the wall 19. The journal 5 and 6 or end flange 3 or 4 can be cross-sectionally solid between the associated end of the hollow chambers 14 and 15, and its free end face.

At its side remote from the supporting surface 42, the base 41 has a slot-like receptacle 48 for a strip-like tool 44 located between its longitudinal edges or the flange webs 43, and the rear of its two larger strip faces engages in pretensioned manner on one side of the receptacle 45. On the front strip face engages a clamping wedge 46, which can be formed by a plurality of longitudinally, substantially uninterrupted, strung together, identical wedge blocks. The circumferential side of the clamping wedge 46 remote from the axis 10 does not project over the circumferential surface of the end flange 3 or 4, and instead extends radially roughly the same distance as the latter. With its radially inner edge face, the tool 44 is directly supported with respect to the base 41, and via the latter, with respect to the outer surface 13, in a common axial plane of the axis 10.

The receptacle 45 is so extended in the flange 3 or 4, that it passes continuously from the base 41 to the associated outer face. As a result the tool 44 can extend over and beyond the inner face or approximately up to the outer face of the end flange 3 and 4, the end flange 3 or 4 also receiving locking means, such as approximately tangential locking screws, with which the associated end of the tool 44 or clamping wedge 46 is fixed against the associated side of the receptacle 45.

In the case of the end flange 4, the receptacle 45 is located radially outside the engagement member 40 or the outer circumference of the connecting flange 18. The working width of the cutter block 1 is larger than the internal spacing between the inner face of the end flanges 3, 4 and is namely roughly the same as the spacing between their outer faces and therefore slightly larger than the length of the inner face 14 or 15. The tool 44, the receptacle 45 and/or the wedge 46 has the indicated helical pitch about the axis 10.

Figure 2:
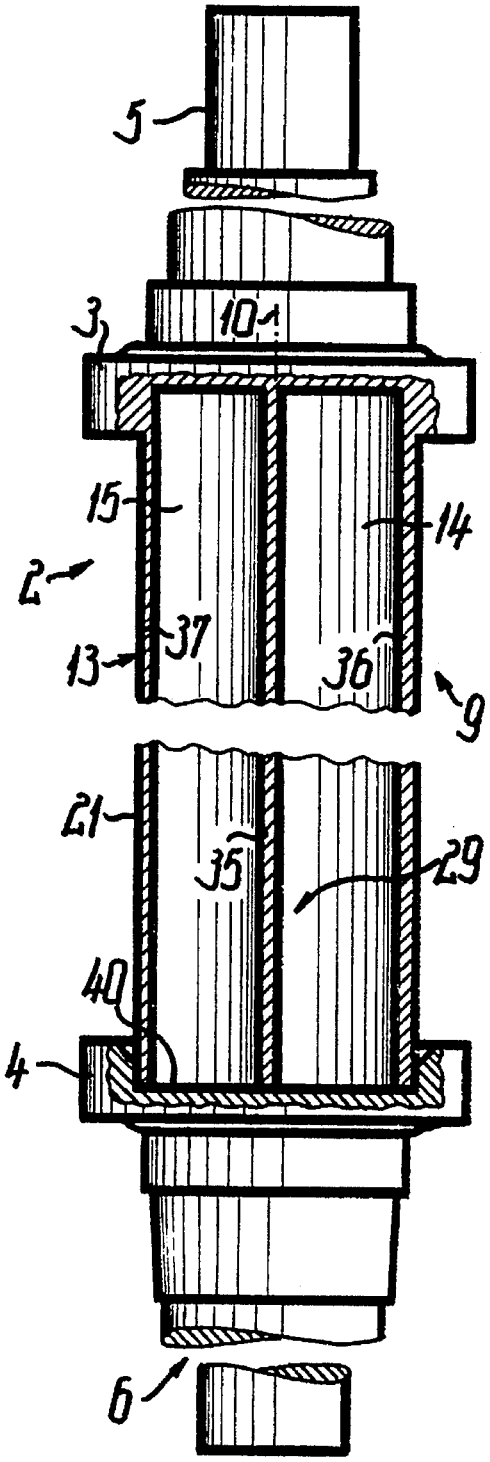
FIG. 2 is a longitudinal section view through the component of FIG. 1.
Figure 6:
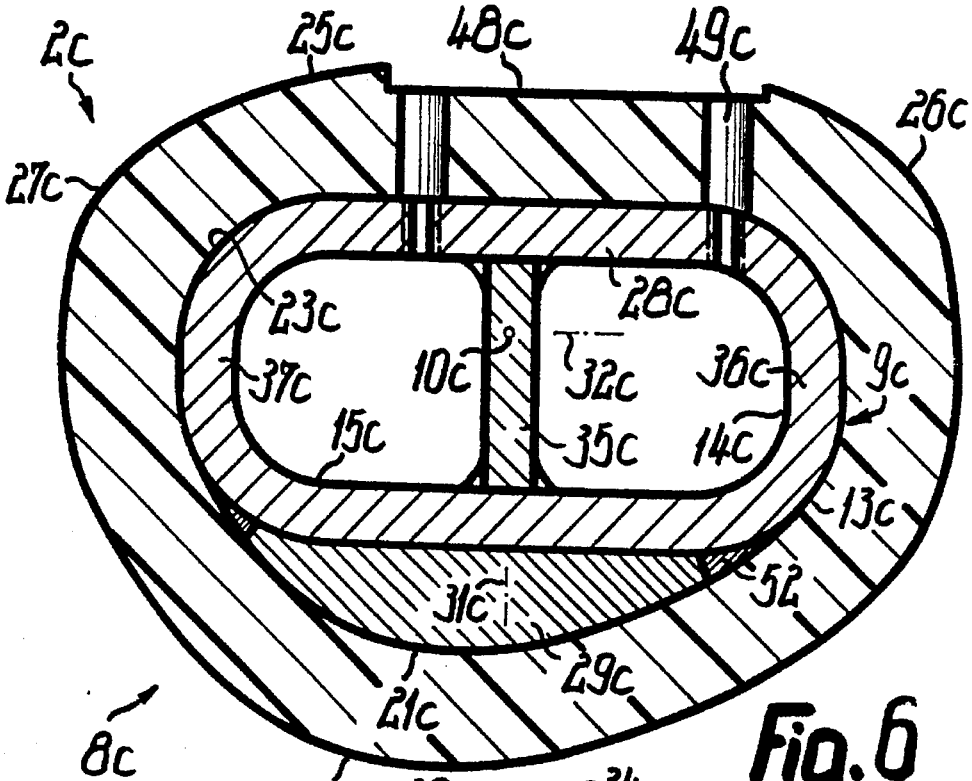
FIGS. 4–6 illustrate three further embodiments in representations corresponding to that of FIG. 3.
Figure 4:
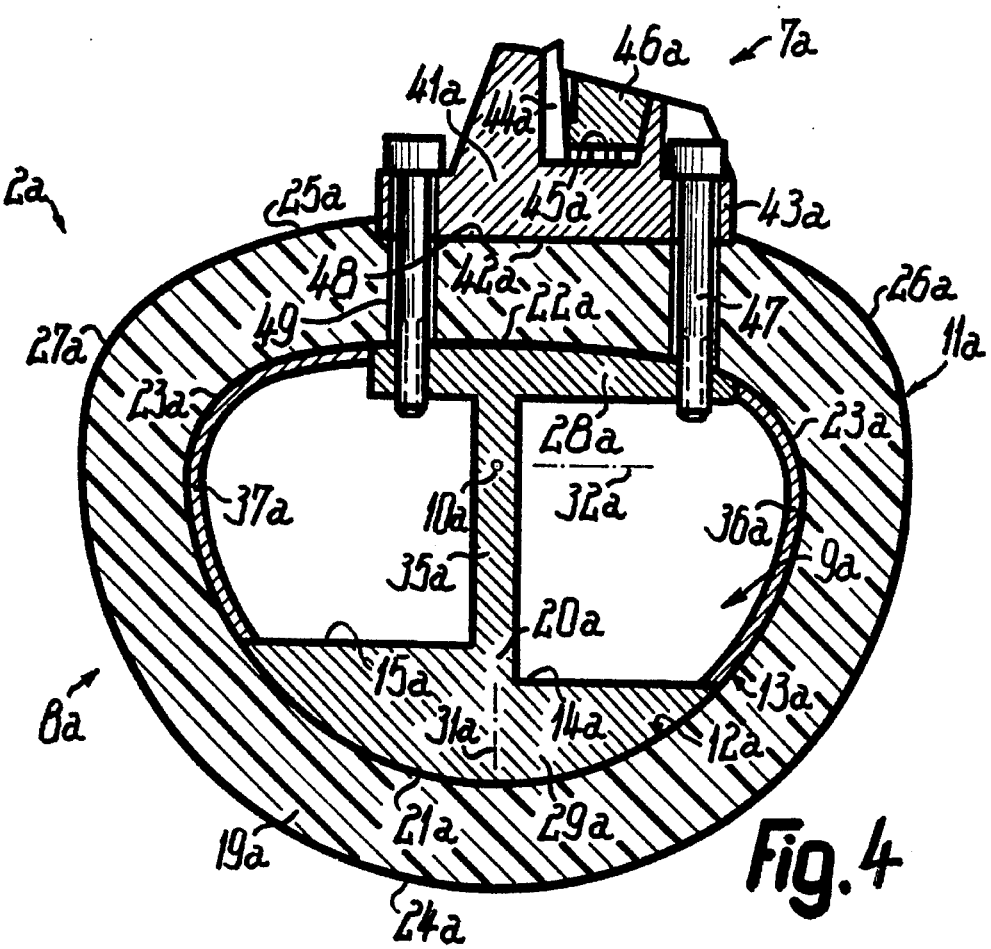
Figure 5:
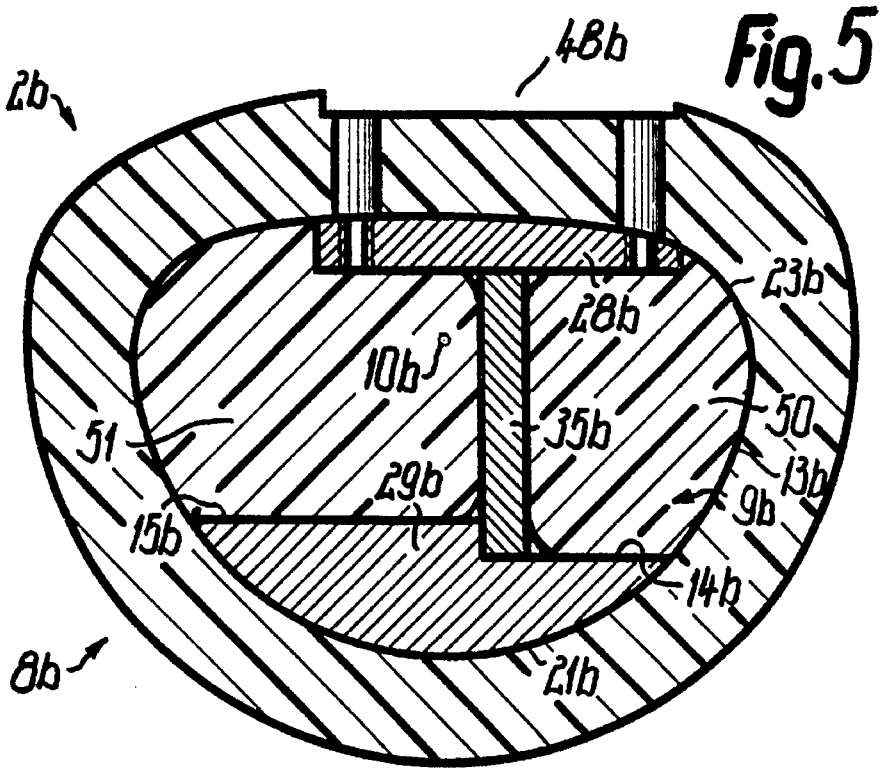

In FIGS. 4 to 6 corresponding parts are given the same references as in FIGS. 1 to 3, but are followed by different reference letters. The inner or outer parts of the different embodiments can also be combined, e.g., in such a way that they are cross-sectionally juxtaposed and/or in the longitudinal direction from succeeding or interengaging portions. All description parts and features apply to all the embodiments.

According to FIG. 4 the inner part **9*a* is assembled from several, initially separate components, which appropriately uninterruptedly extend over the entire length of the body 2*a*. Before or after the assembly of the overall inner part, the particular component can be secured by its end or associated end face to an end flange or journal, namely, e.g., in an engagement member in the manner described relative to the connecting flange 18. The inner part 9*a* has a one-piece main part formed, e.g., by an extruded profile or a profile produced by machining, which is cross-sectionally approximately I-shaped, but is asymmetrical with respect to the axial planes 31*a* and 32*a*. The narrower and/or thinner I-head web forms part of the slightly curved flat surface 22*a* or clamping body 28*a*, whereas the other I-head web forms the weight body 29*a*. The common axial plane of the two gravity axes of the weight body 29*a* and the tool unit 7*a* is advantageously at least approximately also an axial plane of the axis 10*a*, and is correspondingly inclined with respect to the axial planes 31*a* and 32*a***.

In their areas closer to the axial plane **31*a*, the inner surfaces 14*a* and 15*a* are bounded in approximately right-angled, slot-like manner by the main part, whereas in the further removed area they are bounded in curved manner by the axial plane 31***a*. In these areas they are bounded by thin plates 36*a* and 37*a* having an approximately constant wall thickness, which in each case are connected by a longitudinal edge in an approximately obtuse manner to an associated longitudinal edge surface of the clamping body 28*a*, and with the other longitudinal edge to the associated slot side of the main body forming the inner surface of the weight body 29*a*. As a function of whether the components 36*a* and 37*a* are made from plastic, sheet metal, etc., in the vicinity of their longitudinal edges they are fixed to the main part by bonding, welding, etc. The wall thickness of the bent or curved components 36*a* and 37*a* is much smaller than that of the clamping body 28*a*. They form part of the arcuate surface 21*a* and in part, or completely the transition surface 23*a*, and optionally, part of the flat surface 22*a*.

The much smaller width of the clamping body 28*a*, as compared with the weight body 29*a*, at right angles to the axial plane 31*a* is just large enough for the securing members 47 for the tool unit 7*a* to engage in the clamping body 28*a*, and namely with a spacing from the associated longitudinal edge face which is only approximately the same as the diameter of the shank of the securing members 47. Therefore, the clamping body 28*a* projects towards the transition surface 26*a* further over the axial plane 31*a* than towards the transition surface 27*a*, and with respect to the transition surface 26*a*, it projects by roughly the same amount as the weight body 29*a*. On the other side of the axial plane 31*a* the clamping body 28*a* projects much less than the weight body 29*a*.

The plates 36*a* and 37*a* need make little or no contribution to the strength of the inner part 9*a* or the body 2*a*, and merely serve as mould shells of the lost mold core, or which remains in the outer part 8*a*, and which forms the inner part 9*a* for the production of the outer part 8*a*.

The flat surface 25*a* is also slightly curved and it can be seen that between it and the flat surface 22*a* the thickness of the wall 19*a* slightly decreases on either side with increasing distance from the receptacle 48, and then increases roughly to its apex as from the connection to the particular transition surface 26*a* or 27*a*, and then the wall thickness with increasing distance or connection to the wall part between the arcuate surfaces 21*a* and 24*a* constantly decreases again. The last mentioned wall part has roughly a constant thickness over its circumference, but the arcuate surface 24*a* extends over a larger arc angle than the arcuate surface 21*a*, so that the end of the arcuate surface 24*a* is located on the side of the axial plane 32*a* facing the tool unit 7*a*.

Whereas in the embodiment according to FIGS. 3 or 4 the supporting web 35*a* is constructed in one piece with the clamping body 28*a* or the weight body 29*a* and is located in a plane which is slightly set back with respect to the tool 44*a*, in the embodiment of FIG. 5 the I-shaped main part of the inner part 9*b* is formed from several separate, approximately strip or ledge-like components. One component forms the clamping body 28*b*, another the weight body 29*b* and a third the supporting body 35*b*.

The components are connected to one another by welding, bonding, etc., with the supporting body 35*b* being so connected to an offset shoulder of the inner surface of the weight body 29*b* that it is directly supported with respect thereto by a connecting portion of a lateral surface, as well as a longitudinal edge face. The supporting body 35*b* is only connected by the other longitudinal edge face to the clamping body 28*b*. The median plane of the supporting body 35*b*, whereof several can be provided in spaced juxtaposed manner, in this case passes approximately through the cutting edge of the not shown tool, so that an even more effective support is ensured.

The supporting body 35*b* can also have a cutting edge-corresponding helical pitch with respect to the axis 10*b*, so that in most or all random longitudinal portions of the cutting edge it assumes said optimum support position, and consequently by the tool unit 7*a* during cutting, it is only subject to thrust stress and transversely to its median plane is not bending-stressed.

The inner surfaces 14*b* and 15*b*, whose bottom faces directly adjacent thereto and roughly parallel to one another are formed by the lateral faces of the supporting body 35*b*, and which have longitudinal slot openings directed away from one another and differently high slot sides, are here substantially uninterruptedly or completely filled with shaped bodies 50 and 51, which are appropriately made from a material with a specific gravity which is smaller than that of the materials of the outer part 8*b* or the inner part 9*b*. For example, the body 50 or 51 can be made from a dimensionally stable rigid plastic foam. Of the outer surface 13*b*, the shaped bodies 50 and 51 form those areas as described relative to plates 36*a* and 37*a*, so that the bodies 50 and 51 are components of the mold core for the outer part 8*b*.

The inner part 9*c* according to FIG. 6 is formed by a circumferentially closed tube profile which is seam-free and/or provided with at least one longitudinal seam, which is cross-sectionally elongated or flat oval, and has its greatest cross-sectional extension roughly parallel to the axial plane 32*c*. One of the two wider walls forms the approximately planar clamping body 28*c*, which is closer to the axis 10*c* than the weight body 29*c* or the facing, approximately planar and/or parallel tube wall. The latter forms a support body for the securing of a separate weight body 29*c*, which is flat attached to the outside of said tube wall approximately over the entire width thereof. Securing seams 52 located laterally on the narrow longitudinal edges faces of the weight body 29*c* form a continuous extension of the convex curved outer surface of the weight body 29*c*, and pass progressively or tangentially into more strongly convexly curved transition surfaces of the tube profile, which link its associated wall with the walls 36*c* and 37*c* located on the narrow sides, and therefore, form components of the outer surface 13*c*. In correspondingly approximately quadrantally curved manner, the clamping body 28*c* passes into the narrow tube walls, so that a substantially symmetrical hollow profile to two right-angled longitudinal planes is formed.

Unlike in the embodiment according to FIG. 4, the arcuate surfaces 21*c* and 24*c* are not symmetrical to the axial plane 31*c*, and instead have on the side of said plane 31*c* associated with the front of the tool a smaller radial spacing from the axis 10*c* than behind it. Therefore, the outer part 8*c* also forms a component of the balancing mass for compensating the unbalance mass formed by the tool unit. The two wider tube walls of the inner part 9*c* can be interconnected by means of a cross-sectionally elongated, rectangular supporting strip 35*c*, whose cross-sectional extension which is roughly parallel to the axial plane 31*c* is much larger than approximately parallel to the axial plane 32*c*.

The inner part can also be completely constructed without a supporting body in such a way that a single inner surface of the inner part continuing uninterruptedly over the entire circumference is formed. The supporting body can also be formed by a shaped body substantially completely filling the hollow profile of the inner part in the described manner. Without the weight body, only the clamping body or without the latter only the weight body can be provided as the inner part and a clamping body and a weight body separate from the latter can be interconnected solely by a shape or intermediate body of the described type.

Moreover, such a shaped body can over the circumference substantially completely form the outer surface of the inner part and optionally embedded or in countersunk manner can have at least one clamping body and/or at least one weight body, so that the outer surface of the inner part over the entire circumference substantially is made from the same material or plastic. The clamping body and the weight body, the support body and/or the entire inner part can advantageously be formed as separate longitudinal portions, which are spaced longitudinal and/or circumferentially and are appropriately uniformly distributed over the entire length of the body.

It is also possible not to make the outer part from a plastic, but, e.g., instead to make it from a metallic material, e.g., a cast material, or as a forging. In any case for certain applications there is no need for an inner part, so that the inner surface of the outer part is exposed or the inner part, after producing the outer part, is drawn out partly or entirely as a reusable mould core.

For balancing purposes in at least one inner chamber of an outer or inner part can be filled an initially flowable and then solidifying material, e.g. molten tin. Filling appropriately takes place by means of an included bore, which is provided in the component forming the end flange 3 and 4 or the journal 5 and 6. If the hollow chamber is only to be filled to part of its length, then the inner chamber can be divided off by a partition inserted in the hollow chamber. Filling appropriately takes place with the tool body roughly horizontal, so that as a function of the degree of filling on the top there is a free fluid level for forming the associated boundary and outer surface of the balancing weight.

I claim:

1. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*b*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*) having a radially non-symmetric shape along a cross-section of said machining section, and at least one of each of said inner and outer surface (12, 13) directly rigidly interconnecting with the other, wherein at least one of said inner body component (9, 9*b*) bounds at least one of a hollow circumferentially substantially closed chamber channel and a niche, at least one of said inner body component (9, 9*b*) providing an oblong hollow profile internally having at least one hollow chamber.

2. The machining bar according to claim 1, wherein at least one of said inner body component (9, 9*a*, 9*b*, 9*c*, 9*d*) extends over 1/20 to 20/20 of an overall length extension of said bar body (2, 2*a*, 2*b*, 2*c*, 2*d*).

3. The machining bar according to claim 1, wherein said at least one inner body component (9, 9*a*, 9*b*, 9*c*, 9*d*) is directly connected to at least one axle journal (5 or 6) provided for operationally supporting said machining bar (1), and said at least one outer and inner surface (12, 13) extending around said central bar axis (10) in a cross-section direction with respect thereto.

4. The machining bar according to claim 1, wherein within said outer chamber surface (13), at least one of said inner body component (9, 9*b*) bounds at least one cavity (14, 15 or 14*b*, 15*b*) over at least a partial circumference of said at least one cavity (14, 15 or 14*b*, 15*b*).

5. The machining bar according to claim 1, wherein at least one of said inner body component (9) provides a shaping body for die shaping at least one of said outer body component (8), at least one of said outer body component (8) over at least most of a length extension closely engaging on at least one of said inner body component.

6. The machining bar according to claim 1, wherein at least one end flange is provided, at least one of said outer body component (8) extending substantially flush up to at least one of said end flange (3, 4).

7. The machining bar according to claim 1, wherein at least one of said outer body component (8) provides wall sections defining wall thicknesses, in an unloaded state said wall thicknesses varying at least one of abrupt and continuously.

8. The machining bar according to claim 1, wherein at least one of said inner body component (9) provides a straining body (28) for at least one of radial and longitudinal tensioning.

9. The machining bar according to claim 1, wherein at least one of said inner body component (9) provides a substantially flat locking plate for at least one of positively receiving fastening members (47) and supporting an inner circumference of at least one of said outer body component (8) in the vicinity of a tool unit (7).

10. The machining bar according to claim 1, wherein at least one of said components (8, 9) provides an unbalance counterweight (29) for a dynamic balancing of said machining bar (1).

11. The machining bar according to claim 1, wherein around said bar axis (10) said machining bar defines a machining flight circle (34) of a circle radius of at least one tool (44), said at least one tool (44) in an operating state defining a radial extension radially to said bar axis (10), said circle radius being at the most as large as a sum of a maximum radial extension of said bar body (2) and said radial extension defined by at least one of said tool (44).

12. The machining bar according to claim 1, wherein said at least one inner body component includes a rod profile which is assembled to be a dimensionally rigid structure from at least two separate subcomponents, and is stabilized by at least one connecting structure (52) rigidly interconnecting said at least two subcomponents.

13. The machining bar according to claim 1, wherein in cross-section at least one of said body components (8, 9) has at least one flattened circumference providing varying spacings from said bar axis (10).

14. The machining bar according to claim 1, wherein at least one of said body component (8, 9) has at least one of outer and inner surfaces (11, 12 or 13, 14, 15), at least one of said surfaces (11, 12 or 13, 14, 15) having continuously varying spacings from said bar axis (10).

15. The machining bar according to claim 1, wherein at least one of said body component (8, 9) has at least one of outer and inner surfaces (11, 12 or 13, 14, 15), at least one of said surfaces being substantially D-shaped in cross-section.

16. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and for mounting at least one tool unit (7) through the use of force, said means for mounting including a receiving portion for receiving said tool unit (7) therein, said receiving portion being operatively connected to said at least one inner body so that at least a portion of said force is transferred to said at least one inner body unit.

17. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said at least one inner body component (9, 9*a*, 9*b*, 9*c*, 9*d*) having a larger mass on a side adjacent to said bar axis (10, 10*a*, 10*b*, 10*c*, 10*d*) remote from an external tool unit (7) than on another side adjacent to said bar axis (10) and facing said tool unit (7).

18. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said at least one inner body component (9, 9*a*, 9*b*, 9*c*, 9*d*) having portions located on sides adjacent to said bar axis (10, 10*a*, 10*b*, 10*c*, 10*d*) and directly interconnected by at least one stiffening member, (35, 36, 37), which in cross-section comprises an imaginary extension of at least one of said stiffening member (36, 26, 37), extending substantially through a receiving portion for a tool carrier base (41) and a circumferentially restricted machining zone of a tool unit (7).

19. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said machine bar defining a machine flight circle (34) around said bar axis (10) of a circle radius of at least one tool (44), at least one of said tool (44) in an operating state defining a radial extension radially to said bar axis (10), said circle radius being at the most as large as the sum of a maximum radial extension of said bar body (2) and said radial extension defined by at least one of said tool (44), said circle radius of at least one of said tool being smaller than a sum of said maximum radial extension of said bar body (2) and half said radial extension of said at least one tool (44).

20. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said machine bar defining a machine flight circle (34) around said bar axis (10) of a circle radius of at least one tool (44), at least one of said tool (44) in an operating state defining a radial extension radially to said bar axis (10), said circle radius being at the most as large as the sum of a maximum radial extension of said bar body (2) and said radial extension defined by at least one of said tool (44), said circle radius of at least one of said tool (44) being substantially larger than a largest radial extension of said bar body (2) by a radial extension of a freeing backface of said at least one tool (44).

21. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially symmetric shape along a cross-section of said machining section, and at least one of each of said inner and outer surface (12, 13) directly rigidly interconnecting with the other, and at least one of said outer body component (8*a*) having at least one reception (48) for positively holding at least one tool unit (7*a*) against motion in a substantially circumferential directions around said bar axis (10*a*), at least one of said outer body component (8*a*) having at least one slot-shaped reception depression (48) for receiving at least one of said tool unit (7*a*) via an interengagement substantially free of motion play.

22. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and at least one of said outer body component (8*a*) providing a pressure resisting wall defining an intermediate member between at least one of two clamping members (28*a*, 41*a*) and two supporting members including a tool unit (7*a*) located on an outside of said pressure resisting wall and a counter member located on an inside of said pressure resisting wall.

23. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said at least one inner body component (9) is part of an oblong rod profile extending throughout said machining bar which is of substantially constant cross-section.

24. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section, and at least one of each of said inner and outer surface (12, 13) directly rigidly interconnecting with the other, and said at least one inner body component (9, 9*a*, 9*b*, 9*c*, 9*d*) is part of a rod profile which has been manufactured substantially without cutting.

25. A machining bar, including a machining section for machining materials, comprising:

at least one basic bar body (2, 2*a*, 2*b*, 2*c*, 2*d*) having a longitudinally oblong-shaped extension, said bar body extending longitudinally along a central bar axis (10, 10*a*, 10*b*, 10*c*, 10*d*) which extends along said oblong extension, said at least one bar body having ends, with said machining section located between said ends, said at least one bar body being assembled from at least two body components, including at least one outer body component (8, 8*a*, 8*b*, 8*c*, 8*d*) and at least one inner body component (9, 9*a*, 9*b*, 9*c*, 9*d*), said inner body components being located substantially nearer to said bar axis (10, 10*a*, 10*b*, 10*c*, 10*d*) along a cross-section of said machining section than said at least one outer body component, said at least one outer body component (8) having an inner surface (12), and said at least one inner body component (9) having an outer surface (13) surrounded by said inner surface (12), said outer and inner body components being substantially fixedly interconnected against reciprocal motions with respect thereto in a circumferential direction around said bar axis (10, 10*a*, 10*b*, 10*c*, 10*d*), said outer surface (13, 13*a*, 13*b*, 13*c*, 13*d*) of said at least one inner body component (9, 9*b*, 9*c*, 9*d*) having a radially non-symmetric shape along a cross-section of said machining section of said machining section, and at least one of each of said inner and outer surface (12, 13) directly rigidly interconnecting with the other, and at least one of said body components (8, 9*b*) is provided by an at least partly non-metallic molded body.

26. The machining bar according to claim 25, wherein at least one of said body components (8) is a composite body including flat fibrous reinforcement material arranged in superimposed layers and a hardenable binder.

27. The machining bar according to claim 25, wherein at least one of said body components (8) includes a reinforcing material woven from reinforcing threads and defining an overall length extension, at least over more than half of said length extension said reinforcing threads being free of free ends in at least one of a marginal area of said reinforcing material and an area adjacent to at least one end of said bar body (2).

* * * * *